United States Patent [19]

Merrick

[11] 4,326,493

[45] Apr. 27, 1982

[54] MULTIPLE SPARK DISCHARGE IGNITION SYSTEM

[75] Inventor: James W. Merrick, El Paso, Tex.

[73] Assignee: Autotronic Controls, Corp., El Paso, Tex.

[21] Appl. No.: 60,902

[22] Filed: Jul. 26, 1979

[51] Int. Cl.[3] ..... F02P 3/04

[52] U.S. Cl. ..... 123/606; 123/620; 123/637; 315/209 T

[58] Field of Search ..... 123/148 E, 148 DC; 315/209 T, 223, 224

[56] References Cited

U.S. PATENT DOCUMENTS

| | | | |
|---|---|---|---|
| 3,645,246 | 2/1972 | Campbell et al. | 123/148 E |
| 3,709,206 | 1/1973 | Myers | 123/148 E |
| 3,892,219 | 7/1975 | Preiser et al. | 123/148 E |
| 3,934,570 | 1/1976 | Asik et al. | 123/148 E |
| 3,945,362 | 3/1976 | Neuman et al. | 123/148 E |
| 4,059,084 | 11/1977 | Jundt | 123/148 E |
| 4,122,814 | 10/1978 | Ford | 123/148 E |
| 4,131,100 | 12/1978 | Merrick | 123/148 E |
| 4,149,508 | 4/1979 | Kirk et al. | 123/148 CB |
| 4,177,818 | 10/1979 | Bodig et al. | 123/148 E |

*Primary Examiner*—Charles J. Myhre
*Assistant Examiner*—Andrew M. Dolinar
*Attorney, Agent, or Firm*—Fitch, Even, Tabin, Flannery & Welsh

[57] ABSTRACT

In an ignition system for an internal combustion engine, current from a d.c. power supply is applied through an input inductor alternately through an ignition coil and through a circuit path in shunt of the ignition coil. The current through the ignition coil is made of substantially constant predetermined magnitude while flowing through the shunt circuit, preferably by means of a fixed ballast resistor in the shunt circuit. Switching of the current into the ignition coil is enabled during a predetermined fraction of the engine cycle, with no current applied to the ignition coil between predetermined periods. The current is switched back and forth between the two paths a plurality of times during each predetermined period.

10 Claims, 2 Drawing Figures

MULTIPLE SPARK DISCHARGE IGNITION SYSTEM

Figure 1:
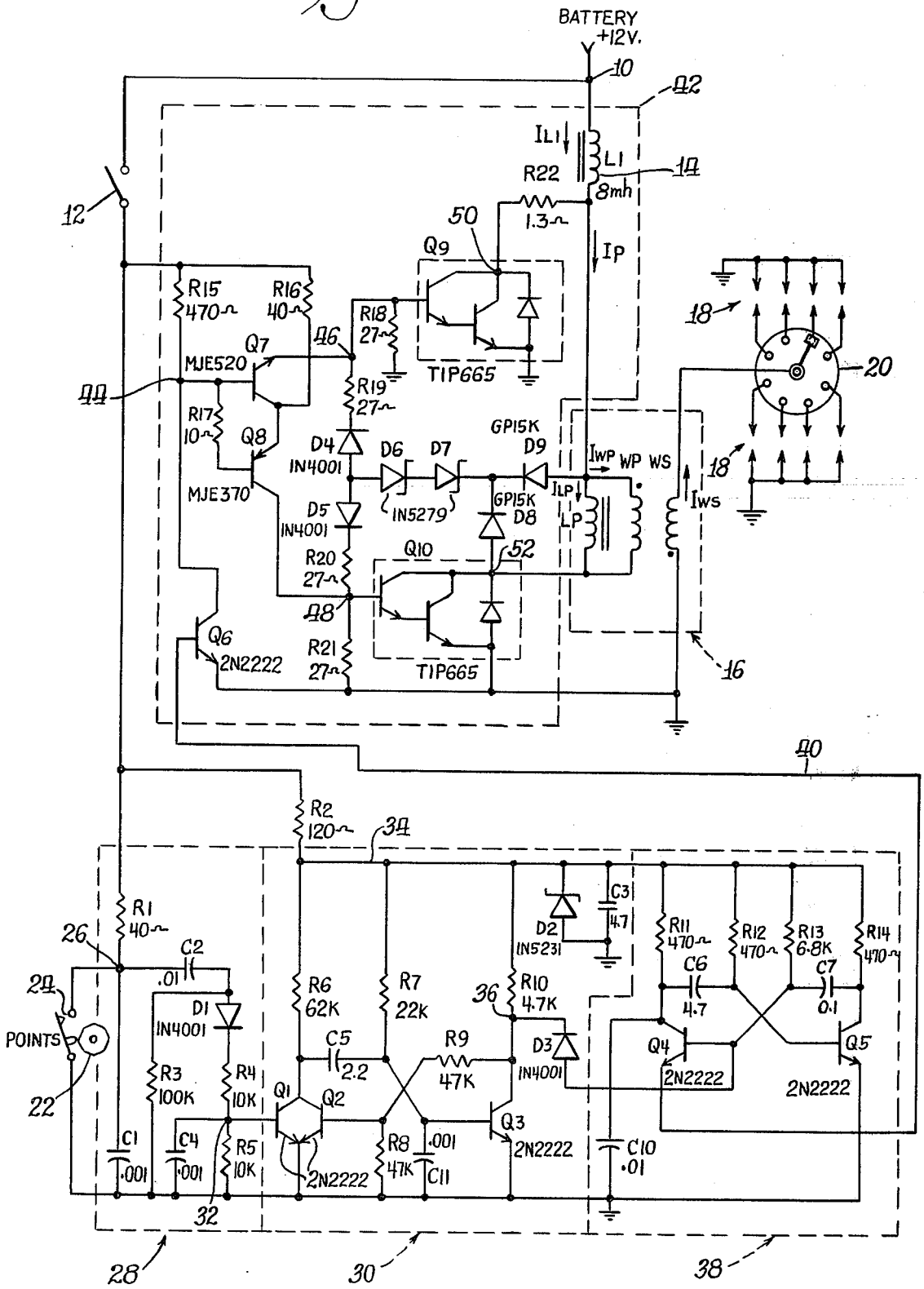

This invention relates generally to automotive ignition systems and more specifically to multiple spark ignition systems. Still more specifically it relates to such systems wherein the energy for ignition is supplied from a d.c. power supply through an inductor.

In multiple spark discharge ignition systems ignition timing pulses indicate when sparks are to be initiated in the spark gaps of spark plugs in the respective cylinders of an internal combustion engine to cause combustion in the respective cylinders. Following each timing pulse, sparks are generated repetitively in a respective cylinder for a predetermined fraction of each engine cycle. In the systems illustrated in U.S. Pat. No. 4,131,100, the sparking in each cylinder each cycle was caused by repetitively interrupting current passing through an ignition coil, thus causing repetitive sparks to be produced by spark plugs in the respective cylinders during the predetermined interval. That is, current was built up in the primary of the ignition coil and interrupted periodically to produce sparks at the spark plugs, the current being reestablished between sparks. Systems as illustrated in the aforementioned U.S. Pat. No. 4,131,100 have proven effective, but they have certain limitations under certain conditions. At high engine speeds, there may be insufficient time for the current to build up in the ignition coil before its interruption, hence limiting the voltage and energy available for producing sparks at high engine speeds. Further, as the spark energy is derived entirely from the energy stored in the ignition coil at the moment of interruption, the spark energy is limited to the amount of energy storage capacity in the coil.

In multiple spark discharge systems illustrated in U.S. Pat. No. 4,149,508, sparks are struck in both halves of an interruption cycle. That is, current through the ignition coil is repetitively interrupted and sparks are struck both upon current interruption and upon reapplication of the current through the coil. In the system illustrated in FIG. 6 of U.S. Pat. No. 4,149,508, current is supplied to the ignition coil through a storage inductor. During the ignition period the current through the ignition coil is periodically interrupted, the current through storage inductor being shunted to ground during the interruption interval.

The system as illustrated in FIG. 6 of U.S. Pat. No. 4,149,508 has a number of shortcomings. For one thing, the currents through the storage inductor and the ignition coil are undefined. The patent refers to the battery and storage inductor as comprising a constant current source, but in the illustrated circuit the storage inductor can never be so large that the current therethrough cannot change at all, it can only remain substantially constant over the short interruption intervals when the current is shunted to ground. Actually, the current must rise slightly during each such interval and would rise to a very large magnitude if the storage inductor were shunted to ground for a long period. Further, there is nothing shown to limit the current even when it is directed through the ignition coil, and current will rise through the storage inductor and the ignition coil during such intervals, including the quiescent time between ignition times, except as current may be limited by the internal resistance of the battery and the inherent resistances of the storage inductor and the ignition coil. As a practical matter, with ignition coils as commonly used, the steady state current therethrough must be limited to 3–5 a. to avoid overheating.

In accordance with the present invention, energy is also applied from a battery to the ignition coil through an inductor. However, current of predetermined magnitude is developed in the inductor prior to energizing the ignition coil. Hence, when this inductor current is switched into the ignition coil, the current in the ignition coil immediately jumps to a relatively high level, initiating a spark in the respective spark gap almost instantaneously. Energy is thereafter supplied by the battery during the spark. When the ignition coil current is thereafter interrupted, the collapse of the magnetic field in the ignition coil results in a spark in the spark gap of polarity opposite to that of the spark created when the current was switched into the ignition coil. The current is thereafter switched back and forth to produce discharges following so closely as to be practically a continuous discharge. As the systems of the aforementioned U.S. Pat. No. 4,131,100 produce but one spark each cycle, much of the time the ignition coil is merely being reenergized. In the present invention, the energy is not limited by the energy storage capacity of the ignition coil, but is added from the battery during the initial spark. There is no lack of time for the primary current to build up in the ignition coil as it starts with the current built up in the inductor prior to the initiation of the spark.

In accordance with the present invention, a defined current is developed in the input inductor during the quiescent period before the ignition period, and no current flows through the ignition coil. In consequence of having no current flowing through the ignition coil during the quiescent period, its average current is relatively low, permitting relatively high currents during the ignition period, substantially higher than the average currents permissible without overheating. Further, the input inductor need not be so large as to maintain a constant current; it need only be large enough to provide the energy for prompt initial spark breakdown without substantial drop in current. In the preferred embodiment of the present invention, current in the input inductor is maintained substantially constant by making the discharge voltage across the spark gaps, as viewed at the primary of the ignition coil, substantially equal to the battery voltage.

Thus, it is a primary aspect of the invention to provide a multiple spark ignition system in which the energy for ignition is supplied from a power supply through an inductor, and in which current of predetermined magnitude is developed through the inductor prior to an ignition period, the current through the inductor being thereafter switched to flow alternately through two paths, one through the inductor and the other in shunt thereof.

Other aspects and advantages of the invention will become apparent from the following detailed description, particularly when taken in connection with the accompanying drawings in which:

FIG. 1 is a circuit diagram illustrating a multiple spark discharge system utilizing the present invention; and FIGS. 2A–2K are wave forms illustrating voltages and currents appearing at respective points in the circuit illustrated in FIG. 1.

The ignition system illustrated in FIG. 1 is intended for use in a cyclic internal combustion engine, not shown. Power to the ignition system is supplied from a direct current supply which may comprise a 12 v. battery with its positive terminal connected to a terminal 10 and with its negative terminal grounded. An ignition switch 12 connects the control circuit of FIG. 1 to the battery. The battery is also connected through an inductor 14 to an ignition coil 16. Energy from the ignition coil is supplied to a plurality of spark plugs 18 through a distributor 20, as is well known. The ignition coil 16 has a primary winding that receives current from the battery through the inductor 14 and a secondary winding connected to the respective spark plugs by the distributor 20 at appropriate times in the engine cycle. The ignition coil 16 produces high voltage pulses at the respective spark gaps of the spark plugs 18 to produce spark discharges in respective combustion chambers at appropriate times in their respective cycles as initiated by timing signals. In the circuit illustrated, the distributor 20 is coupled to a cam 22 which operates breaker points 24 to produce the timing signals. The breaker points 24 may be identical to the breaker points conventionally used to interrupt the current flow through an ignition coil.

In the embodiment illustrated, the breaker points 24 are connected between ground and an input terminal 26 of an input circuit 28. The input circuit 28 is principally a debounce circuit to assure the proper matching of the timing signal from the points 24 to a firing duration control circuit 30 at its input terminal 32. With the points 24 in their normally closed position, the input terminal 26 is at ground potential, resulting in the terminal 32 being held at ground potential through a resistor R5. When the points 24 are opened by action of the cam 22, the potential of the terminal 26 rises toward the battery potential of +12 v. The rising signal is applied through a coupling capacitor C2, a diode D1 and a resistor R4 to the terminal 32, sharply raising the potential at the terminal 32 and momentarily applying a positive timing control signal to a transistor Q1 of the firing duration control circuit 30. When the points 24 close, the capacitor C2 is discharged through a resistor R3. Because it takes time for the capacitor to discharge, should the points bounce and momentarily open again, the subsequent pulse through the capacitor C2 will be insufficient to retrigger the transistor Q1.

Power is supplied to the firing duration control circuit 30 through a resistor R2 to develop a fixed voltage of about 5 v. on a bus 34 as determined by a zener diode D2. The firing duration control circuit 30 is essentially a univibrator triggered to change state by the signal applied at the terminal 32. In the quiescent state of the firing duration control circuit 30, a transistor Q3 is rendered conducting by the connection of its base to the bus 34 through a resistor R7. This draws current through a resistor R10 and holds an output terminal 36 at a ground potential. This acts through a resistor R9 to hold a transistor Q2 off. When the trigger pulse is applied at the terminal 32, the transistor Q1 is turned on, drawing current through a resistor R6. This applies a signal through a capacitor C5 to turn off the transistor Q3, thus raising the potential at the terminal 36 and the base of the transistor Q2 and turning on the transistor Q2. Current continues to be drawn through the resistor R6 upon removal of the triggering pulse on the terminal 32, with the transistor Q2 conducting and the transistor Q3 nonconducting. Current flows through the resistor R7 to charge the capacitor C5 until the charge on the capacitor C5 reaches sufficient voltage to cause the transistor Q3 to conduct again. This turns off the transistor Q2.

Figure 2:
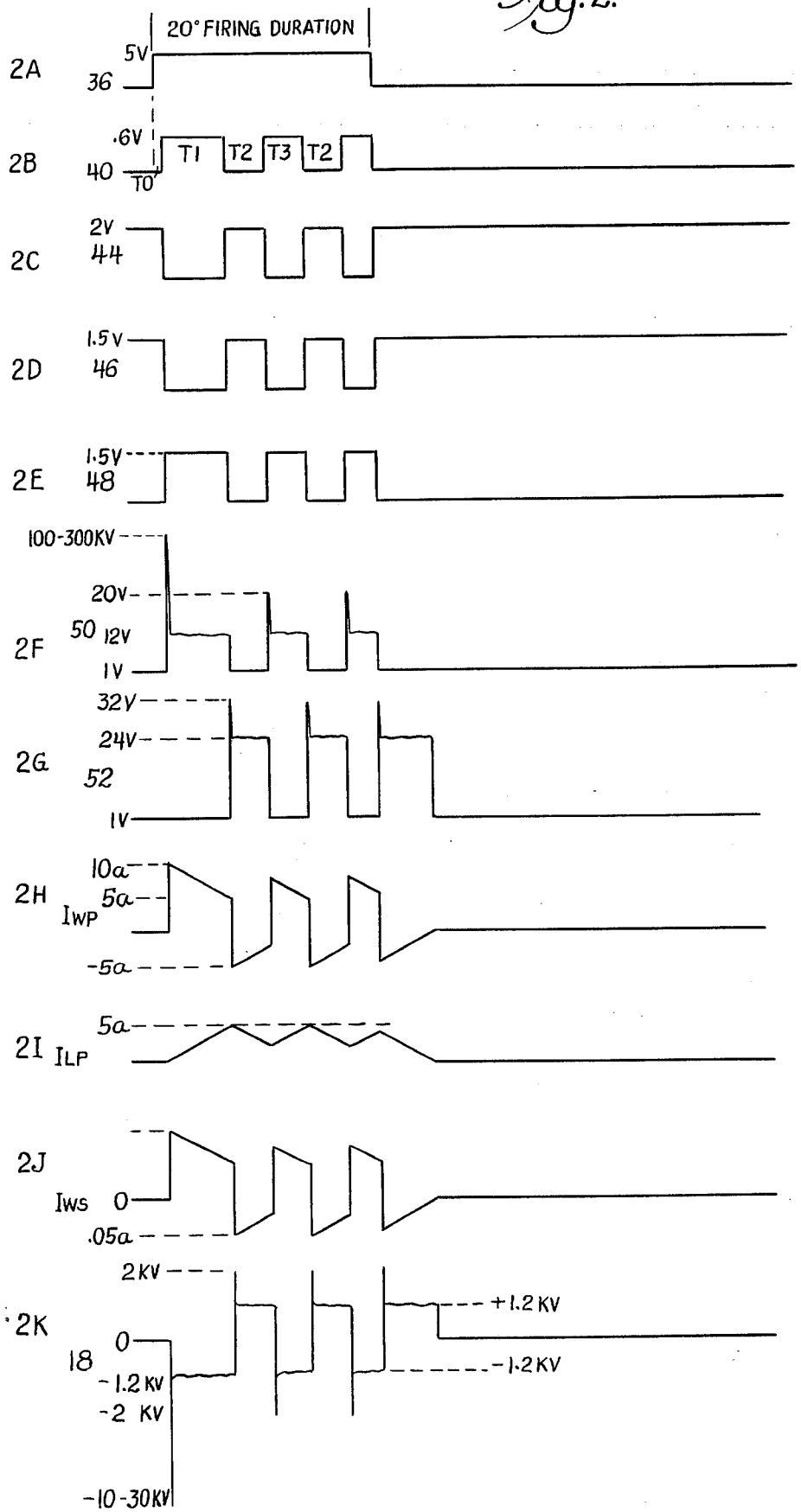

The firing duration control circuit 30 thereafter remains in its quiescent condition until a subsequent trigger pulse appears at the terminal 32. The relative magnitudes of the resistances of resistors R6 and R7 and their relationship to the capacitance of the capacitor C5 determine the effective duty cycle of the firing duration control circuit 30. The charging and discharging rates of the capacitor C5 are made such that the capacitor is not fully discharged by the time the next subsequent timing pulse appears at the terminal 32. Preferably the magnitudes of the resistances and the capacitance are made such that the duty cycle of the firing duration control circuit 30 is about 20° of rotation of the engine, producing an output signal on the output terminal 36 as shown in FIG. 2A. The signal is applied through a diode D3 to an oscillator 38.

The oscillator 38 is shown as a gated multivibrator, enabled by the signal from the firing duration control circuit 30. When the oscillator 38 is so enabled, the output appearing at its output terminal 40 is a square wave signal as illustrated in FIG. 2B. The signal is created by alternately turning a transistor Q4 on and off. The transistor Q4 is alternately off and on for periods T2 and T3, respectively, as determined by the relative times for charging capacitors C6 and C7, respectively, to the points of conduction of transistors Q5 and Q4, respectively. The time intervals T2 and T3 are preferably made substantially equal, for reasons that will appear below.

In the absence of a firing duration control signal from the firing duration control circuit 30, the base of the transistor Q4 is held low through the diode D3. This keeps the transistor Q4 off, hence keeping the transistor Q5 on. This causes the capacitor C6 to be substantially fully discharged. Upon the appearance of the positive firing duration control signal illustrated in FIG. 2A, the base of the transistor Q4 is permitted to rise. The capacitor C7 then charges through a resistor R13. Because the resistor R13 had previously been conducting through the diode D3, the capacitor C7 was charged to the extent of the drop through the diode D3. Hence, the capacitor is charged in a relatively short time T0 sufficiently to turn on the transistor Q4 and hence turn off the transistor Q5. Because the capacitor C6 was initially fully discharged, the time thereafter for it to be charged sufficiently to permit the transistor Q5 to conduct is a time T1 which is longer than the time T3, hence making the first half cycle of the wave form illustrated in FIG. 2B substantially longer than the other half cycles. Thus, the gated oscillator 38 is enabled by the enabling signal (FIG. 2A) from the univibrator 30 to begin oscillating a short time T0 after application of the enabling signal. The oscillator thereafter oscillates in half cycles T1, T2, T3, T2, T3 . . . until the termination of the enabling signal. At the end of the enabling signal, the 20° firing duration signal from the firing duration control circuit 30, the terminal 36 goes low, hence operating through the diode D3 to turn off the transistor Q4 and assure that the signal at the terminal 40 goes low at that time. The output signal on the terminal 40 is limited to 0.6 v., which is the junction drop in a transistor Q6 to which the terminal 40 is connected.

The output signal on the terminal 40 is applied to the base of the transistor Q6 in a switching circuit 42. The signal from the gated oscillator 38 thus causes the transistor Q6 to turn on and off alternately, thus driving low and permitting to go high a terminal 44. The terminal 44 is connected to the 12 v. battery through a resistor R15; however, when the terminal 44 is permitted to go high, there is a conductive path from the terminal 44 to ground through the base to emitter circuits of a transistor Q7 and a Darlington circuit Q9. Hence, the terminal 44, when at its high potential, is at a voltage of about 2 v. The signal at the terminal 44 is hence that shown in FIG. 2C. This signal is applied to the bases of the transistor Q7 and a transistor Q8, turning them on and off oppositely and alternately. In the quiescent state, that is, the state before the 20° firing duration control signal is applied, the signal at terminal 44 is high, hence turning on the transistor Q7 and turning off the transistor Q8.

The turning on and off of the transistor Q7 controls the signal developed at a terminal 46. When the transistor Q7 is off, the terminal 46 is held low through a resistor R18. When the transistor Q7 is on, the terminal 46 attains the voltage of the potential drop across the Darlington circuit Q9. This voltage is about 1.5 v. In the quiescent state, that is, between enabling pulses from the firing duration control circuit 30, the signal at the terminal 46 is high, keeping the Darlington Q9 on. With the Darlington Q9 on, the current flowing from the battery through the inductor 14 is directed through a ballast resistor R22 which limits the current through the induction coil, providing a constant predetermined current through the inductor 14 in the quiescent state and storing energy in the core of the inductor 14. In the quiescent condition, the high signal at the terminal 44 holds the transistor Q8 off which in turn holds a Darlington circuit Q10 off. This precludes current from the battery through the inductor 14 from flowing through the ignition coil 16. Hence, in the quiescent state, no current flows through the ignition coil, and no energy is stored therein.

The turning off and on of the transistor Q7 by the signal developed at the terminal 44 causes the signal at the terminal 46 to follow the signal at the terminal 44. Hence, this signal, shown by the wave form 2D, is similar to the signal shown by wave form 2C but is limited to 1.5 v., the voltage drop across the Darlington circuit Q9. Similarly, the transistor Q8 is turned on and off oppositely by the signal applied at the terminal 44 and hence develops a signal at a terminal 48 which is opposite in phase to the signal at the terminal 46 and is of the wave form illustrated in FIG. 2E, limited in amplitude by the voltage drop across the Darlington circuit Q10.

When the signal at the terminal 46 goes low, it turns off the Darlington circuit Q9 and hence stops the flow of current through the ballast resistor R22. Simultaneously, the transistor Q8 turns on the Darlington circuit Q10. This permits current to flow from the battery through the inductor 14 and thence through the ignition coil. The flow continues thus over the period T1. During the interval T2 the Darlington circuit Q9 and Q10 are reversed in their states of conduction. The states continue alternating over periods T2 and T3 until the end of the 20° firing duration control signal. The current from the battery through the inductor 14 hence is switched alternately into the two conduction paths, one through the ballast resistor R22 and the other through the ignition coil 16.

The ignition coil 16 may be a typical ignition coil as currently used in automobiles and, in particular, may be a current General Motors standard ignition coil in the form of a transformer having a turns ratio of 1:100, thus stepping up the voltage by a factor of 100. In a transformer, the application of a unidirectional current to the primary winding causes a magnetic field to be built up in the core of the transformer, adding energy to the core, where the energy is stored. At the same time, the change of current induces a current spike in the secondary winding of the transformer. For the sake of simplicity of explanation, the ignition coil 16 is illustrated in FIG. 1 in one simplified form of its equivalent circuit. The equivalent circuit is shown as an input iron core inductor LP of 8 mh inductance in parallel with the primary winding WP of a 1:100 turns ratio ideal transformer having a secondary winding WS. In the equivalent circuit, the components performing the two primary functions of the transformer are thus illustrated separately. That is, the power is stored in the input inductor LP and the current transformation takes place between the primary transformer winding WP and the secondary transformer winding WS, stepping up the voltage by a factor of 100 and stepping down the current by a factor of 100. The simplified equivalent circuit illustrated ignores the effects of such things as the resistance and capacitance of the windings and the hysteresis losses in the core, but the circuit is practically accurate for the purposes of the present description under the conditions of use at the intended currents, energy and frequencies.

In the quiescent state between the 20° enabling pulses and through the time T0, current from the battery through the inductor 14 is directed through the current path through the ballast resistor R22, developing the aforementioned constant predetermined current. When the enabled oscillator 38 begins to oscillate at the beginning of the time interval T1, the current flowing through the inductor 14 is directed to the other path, through the primary winding of the ignition coil 16 (the primary winding being shown in two parts LP and WP). As the nature of an inductor is to resist changes in the flow of the current, the current continues to flow through the inductor 14 at substantially the same predetermined rate. As it can no longer flow through the Darlington circuit Q9, it must flow through the primary winding of the ignition coil 16 and the Darlington circuit Q10. However, the current through the equivalent input inductor LP cannot change promptly either, being zero at the time of switching. Hence, the current initially flows through the equivalent primary winding WP at the predetermined rate and is transformed to a corresponding current in the secondary winding WS. The secondary winding is, however, connected to a respective spark plug 18, as determined by the distributor 20, the spark plug presenting an open circuit having a certain effective capacitance. Because current must continue to flow through the inductor 14 and cannot all flow immediately through the equivalent inductor LP, the current in the ideal transformer builds up a charge on the spark plug terminals until the voltage therebetween rises to the breakdown potential of the respective spark gap. With the secondary winding WS connected to drive the center of the spark plug negative with respect to its ground connection, the spark plug will break down at about 30,000 v. With a 100:1 turns ratio, this transforms to 300 v. at the equivalent primary winding WP, developing about the same 300 v. at a terminal 50 of the Darlington circuit Q9, as shown by the wave form illustrated in FIG. 2F. The voltage at the spark gap is illustrated by the wave form shown in FIG. 2K. Once the spark gap is broken down, it maintains a voltage thereacross of about 1,200 v., so long as current is applied thereto. This transforms to about 12 v. at the terminal 50, as illustrated in the wave form of FIG. 2F, being, not coincidentally, the battery voltage.

With the resistance of ballast resistor R22 about 1.3 ohms, the current through the inductor 14 is about 10 a. during the quiescent condition and through time T0. When the Darlington circuits Q9 and Q10 change state at the beginning of the time T1, the 10 a. current through the inductor 14 that formerly flowed through the Darlington circuit Q9 is switched to flow through the ignition coil 16 and the Darlington circuit Q10. As stated before, the current through the equivalent inductor LP cannot change instantaneously. It therefore starts at zero and increases gradually during the interval T1. The remainder of the 10 a. current flows through the equivalent primary winding WP of the induction coil 16, starting at 10 a. and decreasing thereafter as the current builds up in the inductor LP.

The function of the inductor 14 is to provide the voltage for substantially instantaneously breaking down the respective spark gaps. To this end the inductance of the inductor 14 must be large enough that with the desired current flowing therethrough, in this example 10 a., there is sufficient energy stored in the core of the inductor to break down the spark gap, preferably without suffering any substantial diminution in current. This requires a large enough inductance as to maintain the flow of current near 10 a. until the capacitance of the respective spark plugs and other circuitry has charged up to the breakdown voltage of the respective spark gap. In the particular embodiment illustrated, an inductance of about 8 mh has proven satisfactory, this being about the same as the inductance of the equivalent inductor LP.

During the interval T1, while the Darlington circuit Q10 is conducting, the battery supplies power through the inductor 14 to the ignition coil, hence supplying power to maintain the discharge in the spark gap. It also provides the energy for storage in the equivalent inductor LP. Because the spark gap discharge potential as viewed across the equivalent primary winding WP is about the same as the battery potential, namely 12 v., there is substantially no voltage drop across the inductor 14. With no voltage drop to change the current $I_{L1}$ through the inductor 14, it remains the same, namely 10 a. At the same time the current increases in the equivalent inductor LP at a constant rate of 1500 a/sec, the constant 12 v. divided by the 8 mh inductance. As the sum of the current $I_{WP}$ through the equivalent primary winding WP plus the current $I_{LP}$ through the equivalent inductor LP remains constant at about 10 a., the current $I_{WP}$ decreases linearly, and energy is dissipated in the spark gap, heating the air and evaporated fuel in the respective combustion chamber. The current through a spark discharge is not determined by the voltage across the gap. It is whatever current is available, as determined by the other circuit elements, in this case the steady 10 a. through the inductor 14 less the current developing in the equivalent inductor LP. In the particular embodiment illustrated, the current $I_{LP}$ rises to about 5 a. at the end of the interval T1. Hence the current $I_{WP}$ declines to about 5 a. in the same interval.

At the beginning of the time interval T2, the Darlington circuits Q9 and Q10 switch states, and the current through the inductor 14 again passes through the Darlington circuit Q9. Current no longer flows through the Darlington circuit Q10 and the magnetic field in the ignition coil 16 starts to collapse. As viewed in respect to the equivalent circuit shown, with the Darlington circuit Q10 open, the current flowing through the equivalent inductor LP of the ignition coil 16 flows through the equivalent primary winding WP in the direction opposite to current flow during the interval T1, raising the voltage at the spark gap until the spark gap again breaks down, this time in the reverse direction. The breakdown voltage is at a lower level because the gas has previously been ionized and heated. After breakdown, the voltage is again maintained across the spark gap at about 1,200 v., hence, making the voltage at the primary about 12 v. The voltage at an input terminal 52 of the Darlington circuit D10 hence rises promptly to the breakdown voltage plus the battery voltage as applied to the resistor R22. After breakdown, the voltage at the terminal 52 is reduced to the voltage necessary to sustain the discharge. The voltage at the terminal 52 is illustrated by the wave form 2G.

During the secondary discharge occurring in the interval T2, the energy stored in the equivalent inductor LP is dissipated in the discharge, this being the energy supplied to the core of the ignition coil 16 from the battery during the interval T1. However, the timing is such that the energy is not entirely dissipated by the time the period T3 begins; that is, the field has not entirely collapsed to zero. During the interval T2, the constant spark gap voltage as transformed to the equivalent primary winding is −12 v. The rate of change in current $I_{LP}$ through the equivalent inductor LP is therefore equal but opposite to the rate of change of the current $I_{LP}$ during the interval T2. The current $I_{WP}$ in the equivalent primary winding is equal and opposite to the current $I_{LP}$ during the interval T2 in which the Darlington circuit Q10 is non-conducting. It is important to the efficient operation of this invention that the spark discharge not be extinguished during the 20° firing duration signal, except at the changes in direction. Therefore, the current must be maintained at all times and not be permitted to drop to zero, again excepting the change in direction. In fact, it is desirable that the spark current be maintained substantially above zero at all times, as a weak spark can be extinguished by gas turbulence in the gap. As the rate of change of the current $I_{LP}$ is the same but of opposite sense in the intervals T1 and T2, the second half cycle T2 is made shorter than the first half cycle T1 so that there is insufficient time for the current $I_{LP}$ to fall to zero during the interval T2.

At the end of time interval T2, the oscillator 38 again switches the Darlington circuits Q9 and Q10, this time back to the conditions of the interval T1. The action of the interval T1 then is repeated during the interval T3, except that breakdown of the spark gap is at a lower potential, the current $I_{LP}$ starts above zero at whatever current was flowing at the end of interval T2, and the interval T3 is shorter than the interval T1. In fact, it is preferred that the half cycles T2 and T3 be substantially equal in order that the current $I_{LP}$ not drift in one direction or the other. As the rates of change are substantially equal but opposite in the two half cycles, if one half cycle were longer, the current would change more during that half cycle, accumulating a net change after several cycles. The half cycles T2 and T3 are made equal by the timing of the half cycles in the oscillator 38. Small differences in timing are not significant, as the 20° firing duration terminates before the current change accumulates to the point of extinguishing the discharge. The half cycles T2 and T3 thereafter alternate until the end of the 20° firing duration control signal. At that time the circuit reverts to its quiescent condition, and the energy left in the equivalent inductor LP at that time is dissipated in the gap. The wave forms for the currents $I_{WP}$ and $I_{LP}$ are shown in FIGS. 2H and 2I. The spark current $I_{WS}$ is shown by the wave form of FIG. 2J.

It may be noted that current flows into the ignition coil 16 at a magnitude of 10 a. during intervals T1 and T3 and that no current flows into the ignition coil 16 during intervals T0 and T2 or during the time between enabling pulses. In eight cylinder engines, a cylinder fires each 90° of engine rotation. Hence, there is 70° between 20° enabling pulses, during which no current is applied to the ignition coil 16. As this substantially lowers the average current through the ignition coil, it permits relatively large currents to be applied during the intervals T1 and T3, much larger than permissible in the system of U.S. Pat. No. 4,149,508.

Zener diodes D6 and D7 provide overload protection. The sum of the breakdown potentials of these diodes is about 360 v. In normal circumstances, these diodes do not conduct any current. However, should there be a failure in the breakdown of any spark gaps so that the spark gaps do not break down below 36,000 v., the diodes D7 and D6 conduct through a diode D9 or a diode D8 in order to prevent overload between the collectors and bases of the respective Darlington circuits Q9 and Q10. More particularly, in the event of overload, the current passes through a respective diode D4 or D5, a respective resistor R19 or R20 and a respective resistor R18 or R21 to turn on the non-conducting Darlington Q9 or Q10 to dissipate the excess energy without overloading the respective collector to base circuit.

As noted above, the current through the inductor 14 in the quiescent state of the circuit is determined primarily by the resistance of the resistor R22. It is this resistor that develops the current $I_{L1}$ at a suitable constant predetermined magnitude for operating the ignition coil 16. The magnitude of the current $I_{L1}$ is made whatever is suitable for the operation of the system in order to provide power of appropriate magnitude through the spark gap to ignite the fuel reliably at the proper time. The periods T1, T2, and T3 as determined by the gated oscillator 38 are such that with the particular ignition coil utilized, the currents $I_{WP}$ and $I_{LP}$ remain in appropriate ranges.

Although a preferred embodiment of the invention has been shown and described with particularity, various changes in the circuit may be made within the scope of the present invention. For example, it may be noted that a substantial amount of power is lost in the resistor R22. This reduces the efficiency of the system, particularly at low engine speeds, as most of the power lost in the resistor R22 is lost during the interval between the 20° firing duration control signals. It is within the scope of the invention to provide other means for developing a substantially constant current of suitable predetermined magnitude through the inductor 14 at least during the intervals T2 when the current therethrough is directed through the path shunting the ignition coil 16. This may be achieved, for example, by measuring the current through the inductor 14 and switching the battery in and out of the circuit as required to keep the current within predetermined limits, as between 9 and 10 a.

It should also be understood that other timing means may be utilized instead of the breaker points 24. For example, the timing signals may be electronically developed and controlled, as shown in U.S. application Ser. No. 899,355 filed by James Walter Merrick on Apr. 24, 1978 for "Electronic Engine Control", now U.S. Pat. No. 4,284,053, issued Aug. 18, 1981.

I claim:

1. In apparatus for an ignition system for a cyclic internal combustion engine, which system has a d.c. power supply and an ignition coil for developing high voltage for distribution to spark plugs to produce sparks across spark gaps in respective combustion chambers at appropriate times in their respective cycles to ignite the fuel contained therein, said appropriate times being separated by quiescent periods, said ignition coil having a primary winding for receiving current from said d.c. power supply and a secondary winding for connection to said spark plugs, the improvement comprising inductor means for receiving current from said d.c. power supply, switching means for directing current passing through said inductor means from said d.c. power supply alternately into two paths, one path through said primary winding of said ignition coil and the other path in shunt of said primary winding, means for maintaining the current through said inductor means of predetermined magnitude at least during the time intervals said switching means directs the current through said other path just prior to the operation of said switching means to direct said current through said one path, cyclic means for cyclically operating said switching means when enabled, enabling means for enabling said cyclic means for substantially a predetermined fraction of each engine cycle, and timing means for timing the onset of each said predetermined fraction relative to the engine cycle, said switching means directing said current through said other path during the quiescent periods between respective predetermined fractions, with the first spark following a quiescent period being effected upon the subsequent operation of said switching means to direct said current through said one path, and with the first half cycle of said cyclic means in said predetermined fraction being longer than succeeding half cycles and operating to produce a spark discharge in a respective spark gap during said first half cycle.

2. Apparatus according to claim 1 wherein said inductor means comprises an inductor having inductance of magnitude that the energy stored therein when said switching means directs the current therethrough into said other path is sufficient to break down a respective spark gap promptly when the current is switched into said one path.

3. Apparatus according to claim 1 wherein the voltage applied by said d.c. power supply to said inductor means is substantially equal to the normal discharge sustaining potential across the respective spark gaps as observed across said primary winding, and said predetermined magnitude is great enough to provide sufficient power to ignite the fuel in the respective chambers.

4. Apparatus according to claim 3 wherein said inductor means comprises an inductor having inductance of magnitude that the energy stored therein when said switching means directs the current therethrough into said other path is sufficient to break down a respective spark gap promptly when the current is switched into said one path.

5. In apparatus for an ignition system for a cyclic internal combustion engine, which system has a d.c. power supply and an ignition coil for developing high voltage for distribution to spark plugs to produce sparks across spark gaps in respective combustion chambers at appropriate times in their respective cycles to ignite the fuel contained therein, said appropriate times being separated by quiescent periods, said ignition coil having a primary winding for connection to said d.c. power supply and a secondary winding for connection to said spark plugs, the improvement comprising inductor means for receiving current from said d.c. power supply, ballast resistance means, switching means for directing current passing through said inductor means from said d.c. power supply alternately into two paths, one path through said primary winding of said ignition coil and the other path through said ballast resistance means in shunt of said primary winding, cyclic means for cyclically operating said switching means when enabled, enabling means for enabling said cyclic means for substantially a predetermined fraction of each engine cycle, and timing means for timing the onset of each said predetermined fraction relative to the engine cycle, said switching means directing said current through said other path during the quiescent periods between respective predetermined fractions, with the first spark following a quiescent period being effected upon the subsequent operation of said switching means to direct said current through said one path, and with the first half cycle of said cyclic means in said predetermined fraction being longer than succeeding half cycles and operating to produce a spark discharge in a respective spark gap during said first half cycle.

6. Apparatus according to claim 5 wherein said inductor means comprises an inductor having inductance of magnitude that the energy stored therein when said switching means directs the current therethrough into said other path is sufficient to break down a respective spark gap promptly when the current is switched into said one path.

7. Apparatus according to claim 5 wherein the voltage applied by said d.c. power supply to said inductor means is substantially equal to the normal discharge sustaining potential across the respective spark gaps as observed across said primary winding, and the resistance of said ballast resistance means provides a steady state flow of current through said other path that upon switching of the current to the one path the resulting discharges in the respective spark gaps ignites the fuel in the respective chambers.

8. Apparatus according to claim 7 wherein said inductor means comprises an inductor having inductance of magnitude that the energy stored therein when said switching means directs the current therethrough into said other path is sufficient to break down a respective spark gap promptly when the current is switched into said one path.

9. Apparatus according to any one of claims 1 to 8 wherein the cycle of said cyclic means operates said switching means to produce a spark discharge in a respective spark gap during the first half cycle of said cyclic means and thereafter at times before extinction of a discharge in the respective spark gap in either direction of current flow through the spark gap.

10. Apparatus according to claim 1 to 8 wherein the succeeding half cycles are of substantially equal duration at least up to the last half cycle in said predetermined fraction.

* * * * *